US006421863B1

(12) United States Patent
Tiffany

(10) Patent No.: US 6,421,863 B1
(45) Date of Patent: Jul. 23, 2002

(54) PORTABLE BRIDGE FOOTINGS AND ABUTMENTS

(75) Inventor: Clarence V. Tiffany, Clinton, WI (US)

(73) Assignee: Custom Manufacturing, Inc., Clinton, WI (US)

( * ) Notice: Subject to any disclaimer, the term of this patent is extended or adjusted under 35 U.S.C. 154(b) by 0 days.

(21) Appl. No.: 09/669,327

(22) Filed: Sep. 25, 2000

(51) Int. Cl.[7] ..... E01D 15/12; E01D 15/133; E01D 21/00

(52) U.S. Cl. ..... 14/2.4; 14/77.1

(58) Field of Search ..... 14/2.4, 3, 75, 76, 14/78, 15, 13, 77.1

(56) References Cited

U.S. PATENT DOCUMENTS

| | | | | | |
|---|---|---|---|---|---|
| 440,437 | A | * | 11/1890 | Phillips | 14/75 |
| 508,929 | A | | 11/1893 | Fontaine | |
| 534,032 | A | * | 2/1895 | Clymer | 14/3 |
| 542,531 | A | | 7/1895 | Ogle | |
| 596,867 | A | | 1/1898 | Frick | |
| 693,059 | A | * | 2/1902 | Pascale | 14/75 |
| 2,317,016 | A | | 4/1943 | Allen | |
| 2,736,172 | A | | 2/1956 | McChesney | |
| 4,073,025 | A | | 2/1978 | Peckham | |
| 4,304,518 | A | | 12/1981 | Carder et al. | |
| 4,649,588 | A | * | 3/1987 | Taylor | 14/3 |
| 4,965,903 | A | | 10/1990 | Bisch | |
| 5,042,101 | A | | 8/1991 | Huether | |
| 5,325,557 | A | * | 7/1994 | Penuela | 14/2.4 |
| 5,414,885 | A | | 5/1995 | Berlin et al. | |
| 5,771,518 | A | * | 6/1998 | Roberts | 14/75 |

OTHER PUBLICATIONS

Custom Manufacturing, Inc., Blue print of Bridge Riser (side view), Aug. 26, 1998, 1. pg.
Custom Manufacturing, Inc., Blue print of Bridge Riser (front and back view), Aug. 26, 1998, 1 pg.
Custom Manufacturing, Inc., Blue print of Bridge Riser (top view), Aug. 26, 1998, 1 pg.
Custom Manufacturing, Inc., Blue print of Load Bearing Frame and Plate, Sep. 6, 1998, 1 pg.
Custom Manufacturing, Inc., Brochure insert, 1 pg.

* cited by examiner

*Primary Examiner*—Thomas B. Will
*Assistant Examiner*—Alexandra Pechhold
(74) *Attorney, Agent, or Firm*—Lathrop & Clark LLP

(57) ABSTRACT

A portable bridge footing and abutment for supporting bridge decks on soils of insufficient bearing capacity or high water tables or both. The bridge footing includes a riser having a bearing plate, a vertical restraint, and at least one leg that all rise and fall with freeze/thaw cycles or in high water conditions. Further, the riser is designed to accommodate water flow under the bridge.

5 Claims, 3 Drawing Sheets

PORTABLE BRIDGE FOOTINGS AND ABUTMENTS

FIELD AND BACKGROUND OF THE INVENTION

This invention relates generally to bridge footings and abutments, and particularly to portable footings and abutments that can be used in areas of unsatisfactory soil or water table conditions.

Typical bridge footings are constructed on soils that have adequate bearing capacity for the bridge loads that must be carried. The footings are made of reinforced concrete and are intended to have little or no settlement so they can provide the bridge superstructure with a support of constant elevation.

To build a bridge in areas where soil conditions have inadequate bearing capacity, the poor soils are removed and replaced with better soil and well-draining stone. If the area has a high water table, the footings must be formed on top of suitable piles or caissons that transfer bridge loads down to suitable soil or even bedrock. Of course, these additional structures are expensive and time-consuming to build. When they are built in wetlands, additional regulatory approval may be necessary before the bridge can be built.

When soil improvements are necessary, their cost may be prohibitive, especially when the bridge is small or intended to only carry small loads such as small vehicle or foot traffic.

Further, when bridges are no longer necessary or they need repair, it is necessary to perform extensive deconstruction that has a traumatic impact on surrounding wetlands.

Thus, there is a need for an improved bridge footing that can be used for smaller bridges when soil conditions are inadequate, removed when there is no longer a need for the bridge, and used in areas that require minimal environmental impact.

SUMMARY OF THE INVENTION

The present invention overcomes the deficiencies in prior art bridge footings and abutments. The present invention can be used to distribute bridge loads evenly over the soil and permit some vertical displacement from varying water levels and frost heave.

Load distribution is effected by one or more legs that transfer loads downward to a bearing plate. The bearing plate bears on a large area of soil to distribute loads more widely than a typical bridge footing to provide the proper bearing capacity. As water levels rise and fall during the freeze and thaw cycles, the bearing plate and legs minimize the obstruction to water flow under the bridge and they change bridge elevation with the surrounding soil with no adverse consequences for the bridge.

Lateral movement of the bearing plate is restrained by a pipe that is driven deep into the soil. The pipe extends upwardly through a mating hole in the bearing plate to resist lateral movement of the bearing plate, legs, and bridge deck.

Such a bridge footing or abutment can be prefabricated, is inexpensive to install, is suitable for use in small load bridges, and can be removed when the bridge is no longer necessary, all without excessive adverse environmental impact.

DETAILED DESCRIPTION OF THE DRAWINGS

Figure 1:
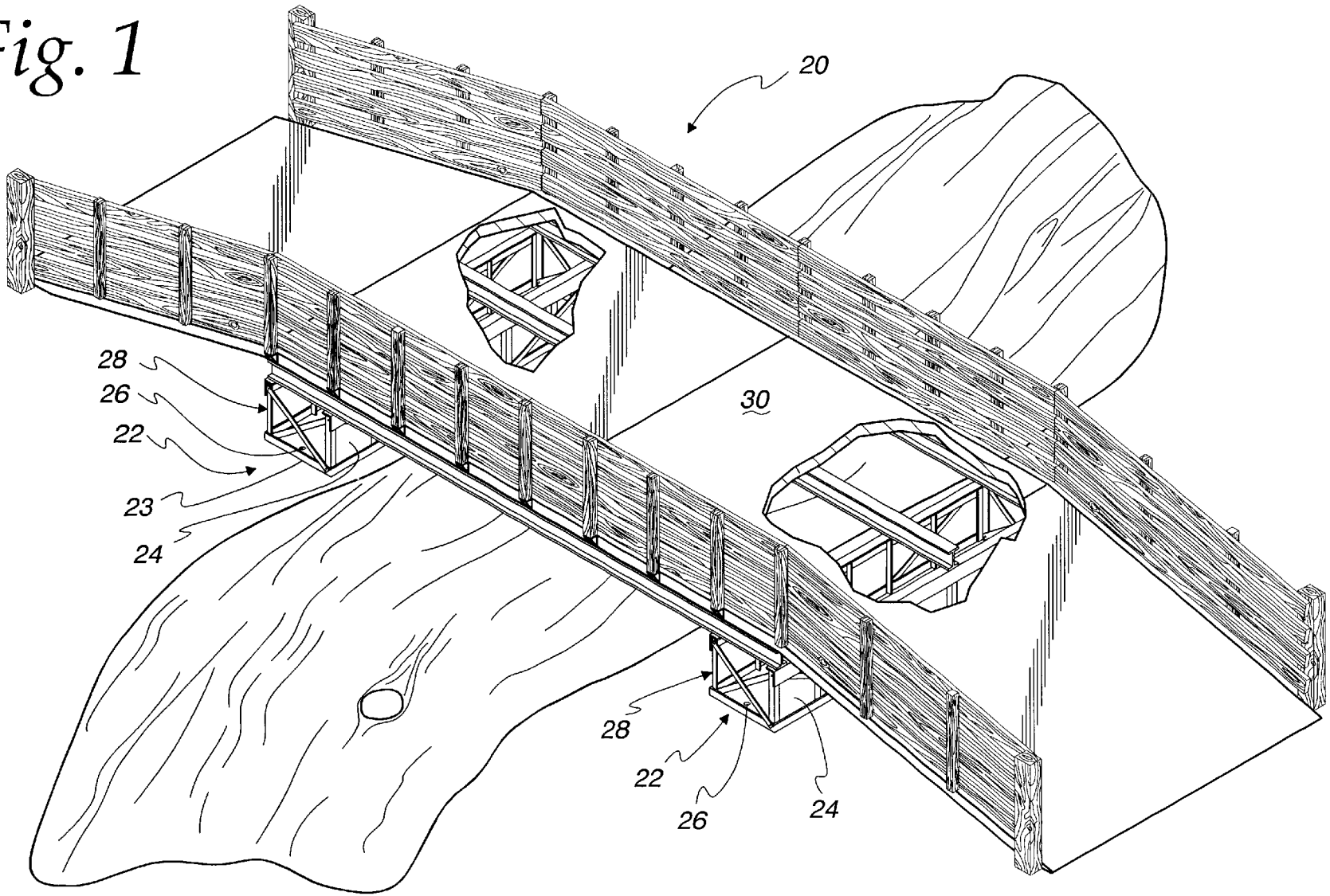
FIG. 1 is a perspective view of a bridge with cut-aways for viewing the bridge supports, in accordance with the present invention.
Figure 2:
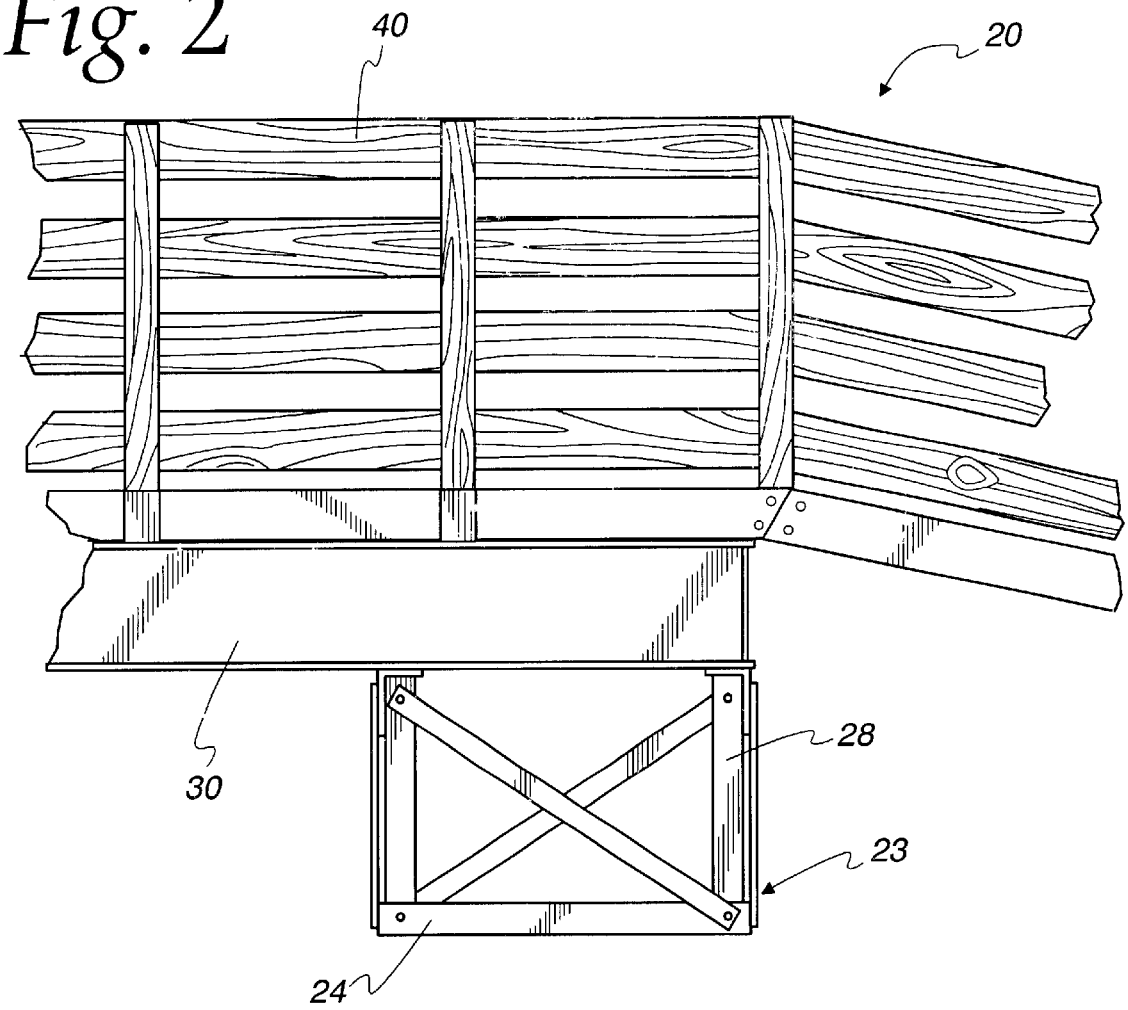
FIG. 2 is an elevational view of the bridge of FIG. 1.
Figure 3:
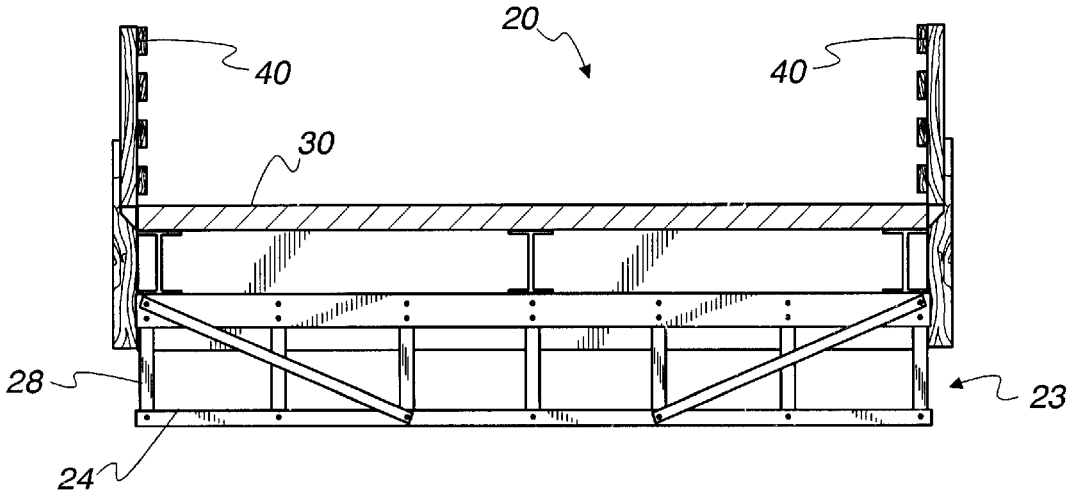
FIG. 3 is a cross-sectional view of the bridge.

In the following detailed description of the drawings, the same reference numeral will be used to identify a corresponding element in each of the figures. Illustrated generally in FIG. 1 is a bridge 20 in accordance with the present invention. The bridge 20 includes either footings or abutments 22 that are constructed with risers 23 that include a bearing plate 24 with a mating hole 26, and legs 28. A bridge deck 30 is added to the top of the risers 23 to complete the bridge 20.

The bridge 20 is designed to carry only relatively light loads such as pedestrian, bicycle, golf cart, and light motorized vehicle loads. Suitable allowable bridge loads are about 30 pounds per square foot and a concentrated load of 10,000 or 12,000 pounds at mid-span. The bridge 20 may include abutments only or it can include an intermediate pier or footing.

The bridge 20 is built in an area where soil bearing capacity is insufficient to withstand a standard bridge abutment or pier. The soil may be in an area where water levels are high or the soil is structurally weak or both. Further, when the water table is high, it tends to fluctuate often with weather conditions. In cold seasons, the water freezes and thaws, and the bridge must compensate for these cycles.

Figure 4:
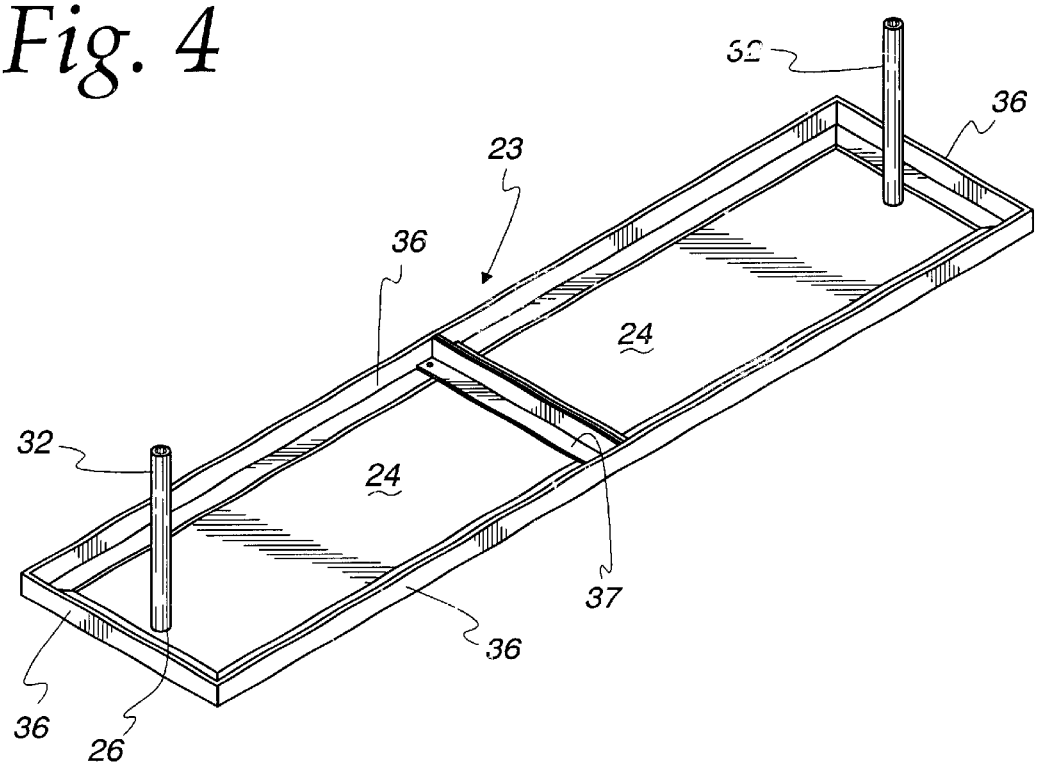
FIG. 4 is a detail of a vertical restraint extending through mating holes in a bearing plate.

As illustrated in FIG. 4, the riser 23 includes a vertical restraint 32 that resists lateral loads. The vertical restraint 32 is illustrated as a round pipe, but could be of any shape such as a steel w-section, angle, rectangular tube, or a built-up member. The vertical restraint 32 is driven into the soil to a depth that will support the lateral loads of the bridge 20, usually 6 feet to 8 feet deep. Because the vertical restraint 32 supports little or no vertical bridge loads it need not be driven so deep as to bear on bedrock or firm soil. To drive in the vertical restraint 32, a hand or mechanical post driver is used.

The height of the vertical restraint 32 above the soil is determined by the expected elevation change in the area over the life of the bridge 20. The vertical restraint 32 need only extend above the highest expected elevation by a few inches to provide lateral support for the bearing plate 24 which essentially floats on the soil to accommodate changing soil and water levels.

The vertical restraint 32 is intended to resist lateral loads for an indefinite period, but is easily removable when the bridge 20 is no longer needed, thus leaving behind no evidence that a bridge was ever there.

Figure 5:
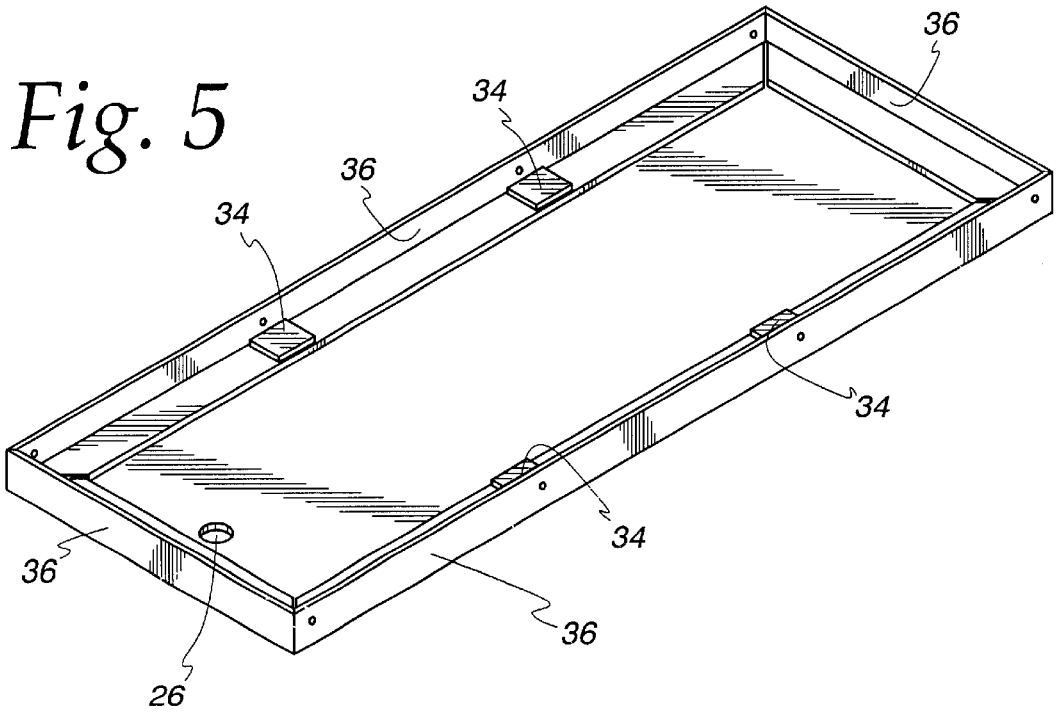
FIG. 5 is a detail of a reinforced bearing plate in accordance with the present invention.

The bearing plate 24 is preferably made of steel and is about 3/16" thick. It is preferably galvanized, painted or coated to resist corrosion. The bearing plate 24 must be of adequate square feet in size and thickness or be reinforced with pads 34 (as seen in FIG. 5) to transfer bridge loads to the soil. The bearing plate 24 also preferably has upturned edges 36 to enhance the plate's ability to bear on uneven soil and it fastens the riser legs to bearing plate. The upturned edges 36 can be formed by ¼"×3"×3" angles joined to the bearing plate 24 or by bonding the edges of the plate 24. Additional angles 37 can be used to provide rigidity to the bearing plate 24.

The bearing plate 24 defines a mating hole 26 through which the vertical restraint 32 extends. The mating hole 26 is illustrated as being round to match the illustrated pipe-shaped vertical restraint 32, but can be any shape that mates with the shape of the vertical restraint 32. The primary role of the mating hole 26 is to provide the vertical restraint 32 with enough clearance for relative vertical movement between the bearing plate 24 and the vertical restraint 32, and to laterally engage the vertical restraint 32 with a slight lateral movement of the plate 24 in any direction.

The bearing plate 24 and the legs 28 form the riser 23. Depending on conditions and usage, the legs 28 can be constructed in any suitable fashion out of posts, trusses, or other built-up sections sufficient to withstand lateral and vertical loads acting on the bridge 20. Other than carrying bridge loads, the legs 28 must be connectable to the bearing plate 24 below, and the bridge deck 30 above. The legs 28 are preferably made of angle iron to minimize the effect on water flow under the bridge 20, but the legs 28 can be of any suitable construction and may even be constructed in a way that only one leg is required.

As seen in FIG. 5, the connection between legs 28 and the plate 24 can be reinforced with a pad 34 of steel or other suitable material. The pad 34 is fixed to the plate 24 and the leg 28. The vertical supports are used to raise the bridge 20 to the proper height above the water and to level the bridge from one bank height to another. The legs 28 must be of sufficient strength to transfer the bridge load evenly downward to the bearing plate 24. The legs 28 are designed to allow the maximum amount of water to flow under the bridge 20 during high water.

Thus, the riser 23 includes the vertical restraint 32, the bearing plate 24, and one or more legs 28. It is the construction of the riser 23 that gives the bridge 20 the ability to accomplish the above-described benefits of this invention.

The bridge deck 30 can be of any suitable construction and is not unique in and of itself. The bridge deck 30 can be constructed, for example, from W-section stringers topped with 2"×10" wood boards which are themselves topped with any suitable surface material. Further, the deck 30 preferably includes a railing 40.

The foregoing detailed description of drawings is presented for clearness of understanding only, and no unnecessary limitations therefrom should be read into the following claims.

What is claimed is:

1. A method for installing a bridge riser, comprising the steps of:

driving a vertical restraint into soil;

placing a bearing plate on the soil the bearing plate having, a mating hole through which the vertical restraint projects to permit relative vertical movement between the vertical restraint and the bearing plate, and to restrain substantial relative lateral movement between the vertical restraint and the bearing plate, the bearing plate for bearing on soil and changing elevations with changes in soil elevation;

joining a leg to the bearing plate to serve as support for a bridge deck.

2. The method of claim 1, in which the step of driving the vertical restraint into the soil comprises the use of a vertical restraint that is a pipe.

3. The method of claim 1, in which the step of placing a bearing plate on the soil comprises the use of a bearing plate with upwardly curving edges to enhance the ability to bear on uneven soil.

4. The method of claim 1, and further comprising the steps of:

driving a second vertical restraint in the soil; and mating the second vertical restraint to extend upwardly through a second mating hole in the bearing plate.

5. The method of claim 1, and further comprising the step of:

attaching a bridge deck to the leg.

* * * * *